United States Patent [19]

Spector

[11] Patent Number: 4,776,323

[45] Date of Patent: Oct. 11, 1988

[54] BIOFEEDBACK SYSTEM FOR AN EXERCISER

[76] Inventor: Donald Spector, 380 Mountain Rd., Union City, N.J. 07087

[21] Appl. No.: 57,116

[22] Filed: Jun. 3, 1987

[51] Int. Cl.[4] ..... A61H 1/02

[52] U.S. Cl. ..... 128/25 B; 84/465; 128/905

[58] Field of Search ..... 84/465; 128/905, 774, 128/25 R, 25 B, 26

[56] References Cited

U.S. PATENT DOCUMENTS

| | | | |
|---|---|---|---|
| 4,058,043 | 11/1977 | Shibahara | 84/464 |
| 4,619,250 | 10/1986 | Hasegawa | 84/465 |
| 4,735,195 | 4/1988 | Blum et al. | 128/25 B |

FOREIGN PATENT DOCUMENTS

| | | | |
|---|---|---|---|
| 3009414 | 9/1981 | Fed. Rep. of Germany | 128/25 A |

*Primary Examiner*—William E. Wayner
*Attorney, Agent, or Firm*—Michael Ebert

[57] ABSTRACT

A biofeedback system to train an exerciser while he carries out athletic activity in which his arm or feet members move rhythmically, the system translating this movement into an audible musical rhythm which makes it possible for the exerciser to being his activity into harmony with a musical rhythm conducive to optimal conditions of exercise. The system includes a compact electronic music synthesizer having a settable rhythm section, the output of the system being fed to a headset worn by the exerciser so that the music heard by the exerciser has a beat determined by the setting. The arm or feet members having sensors attached thereto which yield pulses whose rate is determined by the movement of these members, the pulses being applied to the rhythm section to control the beat setting of the music so that it is in synchronism with the movement of the members.

7 Claims, 1 Drawing Sheet

BIOFEEDBACK SYSTEM FOR AN EXERCISER

BACKGROUND OF INVENTION

1. Field of Invention

This invention relates generally to biofeedback systems, and in particular to a system for use by an exerciser whose rhythmic physical activity is translated into an audible musical rhythm which makes it possible for the exerciser to bring his activity into harmony with a musical rhythm that is conducive to optimal conditions of exercise.

2. Status of Prior Art

An individual's ability to mentally control certain of his physiological functions such as body temperature or blood pressure is known as self-regulation. For hundreds of years in the Far East, Yogis and Zen Buddhists have practiced the art of self-regulation. But with the exception of those committed to transcendental meditation, self-regulation techniques have not been widely practiced in Western society, possibly because many disorders induced or aggravated by stress which lend themselves to alleviation by self-regulation can more readily be treated by medication. Thus, a muscle contraction or tension headache as well as migrane, a vascular headache that is more painful than a tension headache, can, to some degree, be relieved by aspirin and other drugs. Such medication does not do away with stress factors responsible for the headache but serves only to moderate the symptoms. Moreover, aspirin and other drugs, when taken frequently and in large doses, often have deleterious side effects.

In recent years, biofeedback techniques have been developed which represent a more effective form of self-regulation. In biofeedback, an involuntary or unconscious physiologic process, such as the heart beat or the brain wave, is made perceptible to the senses, thereby making it possible for the individual to manipulate the process by conscious mental control.

Stress is expressed in many ways, and may be manifested by a headache or by high blood pressure. Of overriding importance in stress therapy is learning to relax and thereby reduce tension and its physiological consequences. With biofeedback, one is able to achieve mental and physical relaxation by being fed back information regarding an unconscious physiological process. This information is derived by means of a non-invasive sensor which measures peripheral skin temperature or skin resistance, heart rate, blood pressure, pulse rate, and some other process variable.

Thus, a signal from an electromyograph is indicative of varying levels of muscular activity; the higher the signal amplitude, the greater the amount of muscular tension. A high level of muscular tension reflects a high degree of stress, giving rise to tension headaches, facial pain and tics, and other stress-related illnesses. By means of a biofeedback system, one can monitor a specific physiologic process and derive therefrom a visible or audible signal indicative of the process. In this way, the user can manipulate the process being monitored by learning to control the signal it yields. By biofeedback one can reduce muscle tension, slow down a rapid heart rate, regulate blood flow to alleviate circulatory problems and, in general, relax the nervous system.

U.S. Pat. No. 4,461,301 to Ochs shows the basic elements of a biofeedback system of the electronic type. In this system, a sensor serves to produce an analog signal representing the physiological function to be regulated, this signal being digitized to provide a digital display indicating changes in this function. In the Shiga U.S. Pat. No. 4,354,505, a signal derived from the brain of the user acts to frequency modulate an audio oscillator to provide in a loudspeaker an audible sound whose pitch is indicative of the brain activity and serves to facilitate training directed toward relaxation from stress.

It is now recognized that one can relieve stress through exercise, for exercise induces relaxation. (See "Relaxation Through Exercise"—Institute for the Advancement of Health, Vol. 3, No. 3—Summer 1986—pp 56–59.)

The concern of the present invention is an an exercise or sports activity that is rhythmic in nature, such as jogging which involves rhythmic leg activity, or boxing a punching bag which involves a rhythmic arm activity.

In order to gain the greatest amount of benefit from such rhythmic physical activity, the two feet or arms should operate in exact phase opposition. Thus, if one were to convert each cycle of activity into a sinusoidal wave having a positive half cycle representing the forward stroke of the right foot or arm and a negative half cycle representing the forward stroke of the left foot or arm, these half cycles would be of equal duration and amplitude. But in practice, this ideal relationship is difficult to attain and requires training.

It is also important that the frequency or repetition rate of this physical activity lie within a range that is beneficial to the exerciser. Thus, a particular jogger, if he jogs above a certain speed, may quickly become exhausted and he may possibly overtax his heart; but if his jogging speed is too slow, he may gain little benefit from the exercise.

The present invention takes into account the ability of most individuals to respond to the rhythm of music and the fact that they are highly sensitive to even small changes in beat. On the other hand, these individuals may find it difficult to coordinate the movement of their arms or feet with an audible rhythm.

This is the problem experienced when learning to dance; for while the novice dancer has no difficulty in humming along with music as it is being played and in mentally following its beat, he has difficulty in bringing his leg movement in harmony with the beat of the music. Thus, a novice dancer may be familiar with the beat of a waltz, a polka or a fox trot, and knows when the music he hears has the correct beat; but it takes training on his part to move his feet in harmony with the rhythm of the music being performed.

Conversely, if a novice dancer were to hear music whose rhythm were synchronized with the movement of his feet, he would be quick to recognize from the resultant beat of the music that his feet were not producing the desired rhythm. The reason the exerciser is able to sense such disharmony is that his brain has stored in its memory the rhythmic patterns characteristic of various species of music and is therefore sensitive to deviations from these patterns. To give a simple example, if an individual were to hear waltz music being played, and the rhythm of the music were controlled by the movement of his feet, the music would sound right to him only if his feet produced a beat appropriate to a waltz.

SUMMARY OF INVENTION

In view of the foregoing the main object of this invention is to provide a biofeedback training system which responds to the physical movement of the arms or feet of an exerciser to produce synthetic electronic music which is heard by the exerciser and has a rhythmic pattern controlled by this physical movement and is therefore coordinated with the physical activity.

More particularly, an object of the invention is to provide a system of the above type which acts to govern the exercise within settable upper and lower limits appropriate to the individual who is exercising.

Also an object of the invention is to provide a system of the above type which is compact and portable and can be worn by the exerciser without interfering with physical activity.

Briefly stated, these objects are attained in a biofeedback system to train an exerciser while he carries out athletic activity in which his arm or feet members move rhythmically, the system translating this movement into an audible musical rhythm which makes it possible for the exerciser to bring his activity into harmony with a musical rhythm conducive to optimal conditions of exercise. The system includes a compact electronic music synthesizer having a settable rhythm section, the output of the system being fed to a headset worn by the exerciser so that the music heard by the exerciser has a beat determined by the setting. The arm or feet members have sensors attached thereto which yield pulses whose rate is determined by the movement of these members, the pulses being applied to the rhythm section to control the beat setting of the music so that it is in synchronism with the movement of the members.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
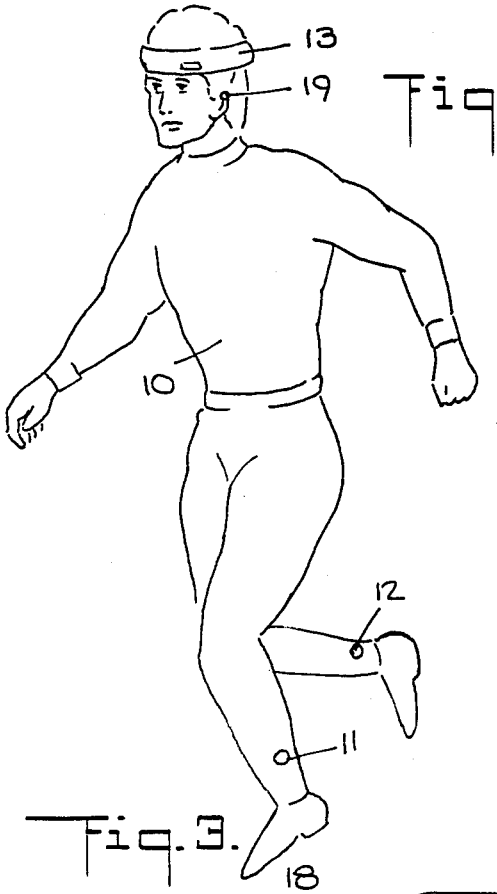
FIG. 1 shows an exerciser wearing a biofeedback system in accordance with the invention.
Figure 2:
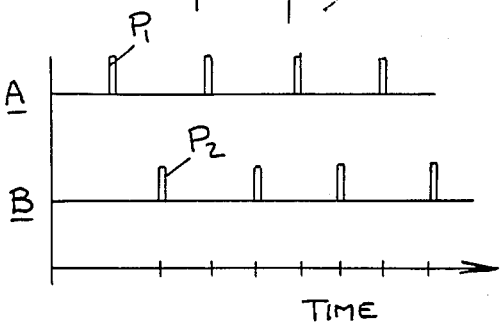
FIG. 2 shows the form of repetitive signal pulses derived from the feet of the exerciser.

Referring now to FIG. 1, there is shown an exerciser 10 who is running or jogging, the movement of his left and right feet being sensed by miniature sensors 11 and 12 attached thereto. As shown in FIG. 2, if the exerciser is running or jogging properly at a steady rate, then his right foot should repetitively hit the ground at the equi-spaced points $P_1$ indicated in line A, and his left foot should hit the ground at equi-spaced points $P_2$ as indicated on line B that are symmetrically staggered with respect to the line A points. Hence the two trains of pulses or points $P_1$ and $P_2$ are in phase opposition. However, the relationship shown in FIG. 2 is idealized, for in practice an exerciser may fail to maintain this optimum relationship, and his left foot pulses may not be equidistant from the right foot pulses.

Figure 3:
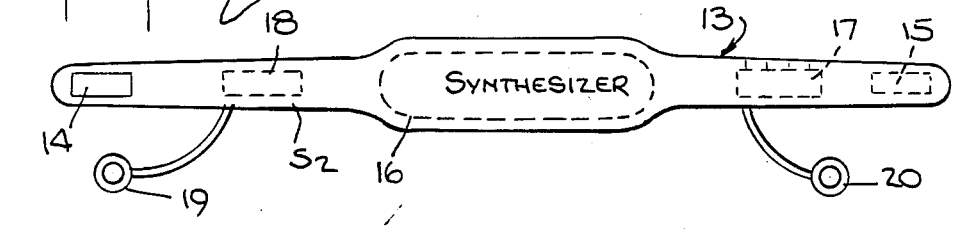
FIG. 3 shows the headband worn by the exerciser.

Encircling the head of the exerciser is a fabric or plastic headband 13 which, as shown separately in FIG. 3, has two straps $S_1$ and $S_2$ which are joined together by a Velcro fastener having a male tape component 14 on one strap and a female tape component 15 on the other, so that the headband is adjustable and can be retained comfortably on the head. Received in a pocket 16 formed in the brow portion of the headband are the main components of the biofeedback system (to be later described) which are in integrated-circuit chip form and therefore small enough to be housed in the headband.

Received in one strap pocket 17 is the control device of the system and in another strap packet 18 are the miniature batteries required by the system.

Figure 4:
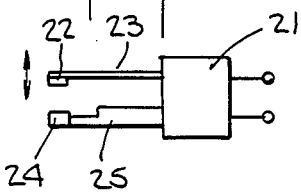
FIG. 4 schematically illustrates a pendulum-type switch serving as a movement sensor.

Extending downwardly from the straps $S_1$ and $S_2$ of the headband is a pair of miniature earphones 19 and 20 which go into the ears of the exerciser, only earphone 19 being visible in FIG. 1. The sensors 11 and 12 which sense foot movement may, as shown in FIG. 4, take the form of a simple pendulum switch 21 in which one contact 22 is mounted on a flexible tine 23 and the cooperating contact 24 is mounted on a stationary support 25. The pendulum switch is so placed on the foot that when it engages the ground, the movable contact, because of acceleration forces, then swings to engage fixed contacts 24 to close the switch.

This switch is connected in series with a voltage source to produce each time the switch is closed a voltage pulse ($P_1$ or $P_2$) whose time positions are shown in FIG. 2. Thus, each time the right foot hits the ground, a pulse $P_1$ is produced by sensor 11, and each time the left foot hits the ground, a pulse $P_2$ is produced by sensor 12. In practice, impact or other forms of sensors may be used for the same purpose.

Figure 5:
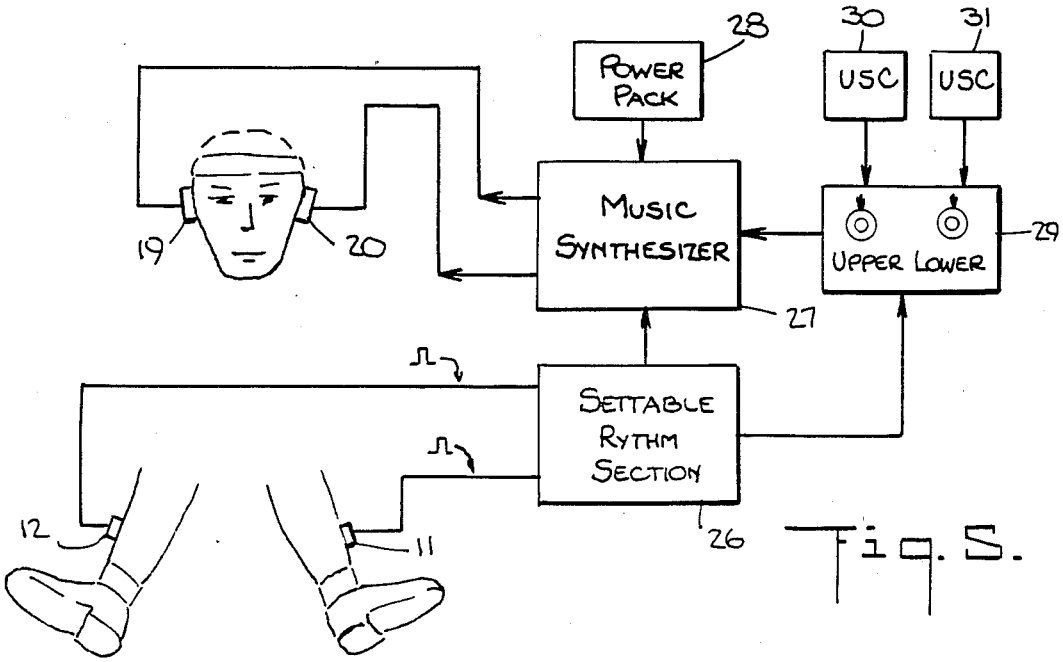
FIG. 5 is a block diagram of the biofeedback system.

As shown in FIG. 5, the pulses yielded by sensors 11 and 12 are applied to the settable rhythm section 26 of an electronic music synthesizer 27. Such synthesizers are well known in the art and are capable of storing digitally and reproducing any musical score. Rhythm sections which cooperate with such music synthesizers to impart a desired beat to the music are also well known, one such rhythm section being disclosed in U.S. Pat. No. 4,058,043.

We shall assume by way of example that the music synthesizer has stored therein a rock and roll musical composition. Rock and roll is jazz music characterized by a strong beat and the repetition of simple phrases often with folk song elements. Because of its strong beat and repetitive character, rock music is well suited for a repetitive and rhythmic exercise such as jogging or punching bag boxing. In jogging, the left and right feet of the jogger move rhythmically in phase opposition, while in boxing it is the arms of the boxer which undergo such movement. Hence when the system is used by a boxer, the sensors are attached to his arms. Repetitive movement of the feet or arm members is also characteristic of many exercise machines, and the benefits of the invention are by no means limited to jogging or boxing.

The system is powered by a power pack 28. Also associated with music synthesizer 27 is a settable control box 29 which when the beat from rhythm section 26 goes above a settable upper limit, then applied to the synthesizer is a high pitched warning signal derived from an oscillator 30. And when the beat falls below a settable lower limit, it applies a low pitched warning signal derived from another oscillator 31.

Thus in operation, assuming that the exerciser is hearing rock and roll music as he jogs, the beat of this music is in synchronism with the movement of his feet, and the faster he runs, the more rapid the tempo or beat, which goes, as it were, from largo to presto. If his left and right foot fail to move in phase opposition, this will be reflected in the beat of the music, and instead of a steady beat in which the pulses are always equi-spaced, the pulses will then vary in their time spacing, and this jerky beat will be evident to the listening exerciser. He can then seek to move his left and right feet so that they have the proper relationship, as indicated by a proper beat. And if the exerciser is running at a speed which exceeds a limit which is safe for him, he will then hear a high-pitched warning signal which will cause him to slow down. But if he is running too slowly, again, as determined by what is too slow for him, he will hear a low-pitched warning signal, and this will cause him to increase speed.

Thus with this biofeedback system, the exerciser is always made aware by way of the rhythm of the music he hears whether his movements are in harmony with what the music should sound like when he is running properly, for his leg or foot movements are translated into a corresponding musical beat. The biofeedback system, therefore, functions as a useful training unit.

While there has been shown and described a preferred embodiment of a biofeedback system for an exerciser in accordance with the invention, it will be appreciated that many changes and modifications may be made therein without, however, departing from the essential spirit thereof.

I claim:

1. A biofeedback system for training an exerciser while he carries out an athletic activity in which his arm or feet members move rhythmically, said system comprising:

A. at least one sensor attached to a foot or arm member to produce a signal pulse each time said member completes a physical movement in a given direction;

B. an electronic music synthesizer having a controllable rhythm section to geneaate music having a pronounced beat;

C. means to apply the signal pulses yielded by the sensor to said rhythm section to so control the section as to synchronize the beat of the music generated by the synthesizer to the movement of the member; and D. means to reproduce said music so that it can be heard by the exerciser who can then modify his activity to attain an optimal rhythmic movement.

2. A system as set forth in claim 1, wherein said synthesizer is formed by integrated circuits and is battery-operated to constitute a portable device which can be worn by th exerciser.

3. A system as set forth in claim 2, wherein the reproduction means are constituted by earphones worn by the exerciser and coupled to the output of the synthesizer.

4. A system as set forth in claim 3, wherein said portable device is housed in a headband worn by the exerciser, and said earphones depend from the headband.

5. A system as set forth in claim 1, wherein said sensor is a pendulum switch.

6. A system as set forth in claim 1, including two sensors attached to the arm members of the exerciser.

7. A system as set forth in claim 1, including two sensors attached to the feet members of the exerciser.

* * * * *